US011125496B2

(12) United States Patent
Lang

(10) Patent No.: US 11,125,496 B2
(45) Date of Patent: Sep. 21, 2021

(54) PROCESS AND DEVICE FOR THE CRYOGENIC SEPARATION OF SYNTHESIS GAS

(71) Applicant: Linde Aktiengesellschaft, Munich (DE)

(72) Inventor: Martin Lang, Munich (DE)

(73) Assignee: Linde Aktiengesellschaft, Munich (DE)

( * ) Notice: Subject to any disclaimer, the term of this patent is extended or adjusted under 35 U.S.C. 154(b) by 429 days.

(21) Appl. No.: 16/064,624

(22) PCT Filed: Dec. 1, 2016

(86) PCT No.: PCT/EP2016/025159
§ 371 (c)(1),
(2) Date: Jun. 21, 2018

(87) PCT Pub. No.: WO2017/108197
PCT Pub. Date: Jun. 29, 2017

(65) Prior Publication Data

US 2019/0056176 A1 Feb. 21, 2019

(30) Foreign Application Priority Data

Dec. 23, 2015 (DE) ..... 102015016771.5

(51) Int. Cl.
*F25J 3/02* (2006.01)

(52) U.S. Cl.
CPC ..... *F25J 3/0223* (2013.01); *F25J 3/0233* (2013.01); *F25J 3/0252* (2013.01); *F25J 3/0261* (2013.01);
(Continued)

(58) Field of Classification Search
CPC ..... F25J 3/0223; F25J 3/0261; F25J 3/0271; F25J 2200/70; F25J 2200/96
See application file for complete search history.

(56) References Cited

U.S. PATENT DOCUMENTS 4,525,187 A * 6/1985 Woodward ..... C07C 7/09 62/627
5,509,271 A 4/1996 Billy et al.
(Continued)

FOREIGN PATENT DOCUMENTS

EP 0677483 A1 10/1995
FR 3011069 A1 3/2015

OTHER PUBLICATIONS

International Search Report dated Mar. 21, 2017 issued in corresponding PCT/EP2016/025159 application (2 pages).
(Continued)

*Primary Examiner* — Brian M King
(74) *Attorney, Agent, or Firm* — Millen, White, Zelano & Branig; Brion P. Heaney

(57) ABSTRACT

The invention relates to a process and device for the cryogenic separation of a methane-containing feed gas predominantly consisting of hydrogen and carbon monoxide, that is partially condensed in this case by cooling, in order to obtain a hydrogen-containing first liquid phase predominantly consisting of carbon monoxide and methane, from which first liquid phase, in an $H_2$ separation column that is heated via a circulation heater, a second liquid phase is generated by separating off hydrogen, from which second liquid phase, in a $CO/CH_4$ separation column, a carbon monoxide-rich gas phase is obtained having a purity that permits release thereof as carbon monoxide product. It is characteristic in this case that a low-methane material stream is withdrawn from the $H_2$ separation column and is then applied to the $CO/CH_4$ separation column as reflux.

19 Claims, 2 Drawing Sheets

(52) U.S. Cl.
CPC ..... *F25J 2200/50* (2013.01); *F25J 2200/70* (2013.01); *F25J 2200/78* (2013.01); *F25J 2200/94* (2013.01); *F25J 2200/96* (2013.01); *F25J 2205/04* (2013.01); *F25J 2210/42* (2013.01); *F25J 2270/12* (2013.01); *F25J 2270/42* (2013.01); *F25J 2270/902* (2013.01); *F25J 2270/904* (2013.01)

(56) References Cited

U.S. PATENT DOCUMENTS

| | | | | |
|---|---|---|---|---|
| 7,107,788 | B2 * | 9/2006 | Patel | C10L 3/10 62/625 |
| 8,640,495 | B2 * | 2/2014 | McNeil | F25J 3/0223 62/622 |
| 2015/0052938 | A1 * | 2/2015 | Bauer | F25J 3/0238 62/612 |
| 2016/0245583 | A1 | 8/2016 | Fernandez et al. | |

OTHER PUBLICATIONS

Linde AG: "Cryogenic Gas Separation: The Most Economic and Experienced Separation Process for Production of Carbon Monoxide and Hydrogen From Raw Synthesis Gases", (Oct. 31, 2012) pp. 1-11.

* cited by examiner

PROCESS AND DEVICE FOR THE CRYOGENIC SEPARATION OF SYNTHESIS GAS

The invention relates to a process for the cryogenic separation of a methane-containing feed gas predominantly consisting of hydrogen and carbon monoxide, that is partially condensed in this case by cooling, in order to obtain a hydrogen-containing first liquid phase predominantly consisting of carbon monoxide and methane, from which first liquid phase, in an $H_2$ separation column that is heated via a circulation heater, a second liquid phase is generated by separating off hydrogen, from which second liquid phase, in a $CO/CH_4$ separation column, a carbon monoxide-rich gas phase is obtained having a purity that permits release thereof as carbon monoxide product.

In addition, the invention relates to a device for carrying out the process according to the invention.

Processes of the type in question have been known to those skilled in the art for many years as what are termed condensation processes. They are preferably used for separating synthesis gases that are obtained by partial oxidation and therefore have a high carbon monoxide content and a low methane content. Assuming that the feed gas has been sufficiently cooled, the condensation process permits a carbon monoxide product to be generated with a yield of more than 90%, that has a methane content of less than 400 vppm and which therefore can be used without a further purification step, for example for generating monoethylene glycol.

In order, in particular, to provide the peak cold required for the process and to generate a reflux at the head of the $CO/CH_4$ column, in the prior art, a cooling circuit is used that uses either externally supplied nitrogen or internally generated carbon monoxide as refrigerant. Each of the two variants is complex and is a considerable cost factor that has a marked effect on the economic efficiency of the gas separation.

For the carbon monoxide circuit, a part of the carbon monoxide-rich gas phase that is obtained in the $CO/CH_4$ separation column and warmed against process streams that are to be cooled is compressed, liquefied against process streams that are to be warmed, and cold-producingly expanded into the head of the $CO/CH_4$ column. Part of the liquid phase accruing in this case forms a column reflux, via which the required purity of the carbon monoxide product is achieved, while the remainder is further expanded in order to deliver the peak cold for the process.

A nitrogen circuit is also used in the prior art to provide peak cold for the process and to generate a reflux for the $CO/CH_4$ separation column that in this case is equipped with a condenser which, cooled by liquid nitrogen, delivers, at the column head, a temperature difference to drive an internal carbon monoxide reflux.

Both cold circuits are driven via multistage compressors. Whereas in a nitrogen circuit a two-stage, preferably inexpensive compressor can be used, for a carbon monoxide compressor, considerably higher costs arise. The reason therefor is, firstly, that a carbon monoxide compressor must be constructed having at least three compressor stages, in order to prevent thermal decomposition of carbon monoxide and soot deposits resulting therefrom. Secondly, it must be explosion-protected, and operated in a particularly safeguarded region in order to prevent escaping of carbon monoxide leading to harm to humans and equipment. The costs for the compressor of a carbon monoxide circuit are therefore up to 50% above those of a compressor that is suitable for driving a corresponding nitrogen circuit.

The cost advantages of the nitrogen circuit resulting on account of the compressor, however, are in part offset by the condenser required at the head of the $CO/CH_4$ separation column and the energy demand that is higher compared with a carbon monoxide circuit that is caused thereby.

The object of the present invention is therefore to specify a process of the type in question and also a device to carry it out, which permit a carbon monoxide product to be obtained at costs that are reduced in comparison with the prior art.

This object is achieved in that a low-methane material stream is withdrawn from the $H_2$ separation column and is then applied to the second separation column as reflux.

When the hydrogen is being separated off from the first liquid phase, the second liquid phase predominantly consisting of carbon monoxide and methane collects in the sump of the $H_2$ separation column, while a hydrogen-rich gas phase is withdrawn overhead.

A gas phase containing hydrogen, carbon monoxide and methane generated by the circuit evaporator ascends from the sump space upwardly and in this respect is brought into intensive contact via separation stages with the first liquid phase that is conducted in counterflow. Because in this case predominantly methane and carbon monoxide are back-extracted from the gas phase and hydrogen is stripped off from the liquid phase, the compositions of the material streams vary continuously in the direction of flow. Whereas, in the gas phase, the fractions of carbon monoxide and—even more intensively—methane decrease and the hydrogen fraction increases, the corresponding fractions develop in the opposite manner in the liquid phase. Therefore, material streams having differing compositions can be withdrawn at different heights from the first $H_2$ separation column.

The invention makes use of the fact that, within the $H_2$ separation column, at least one material stream is present having a suitable composition for use as reflux in the $CO/CH_4$ separation column. In particular, this material stream is low in methane and has a low hydrogen content.

Preferably, the low-methane material stream is withdrawn in the gaseous state from the $H_2$ separation column and is subsequently, by cooling against process streams that are to be warmed and/or a refrigerant is cooled and liquefied before it is introduced as reflux into the $CO/CH_4$ separation column.

In accordance with experience, the gas phase in the $H_2$ separation column, upstream of the sixth practical separation stage, has a suitable composition such that the low-methane material stream can be withdrawn from the $H_2$ separation column in the gaseous state before the sixth separation stage. Downstream of the sixth practical separation stage, the methane content of the gas phase does decrease further, but here the hydrogen fraction is too high for use in the $CO/CH_4$ separation column. Preferably, the take-off site for the low-methane gas phase is situated between the sump space and the third practical separation stage of the $H_2$ separation column.

However, in addition, it is also to be possible, as an alternative or in addition to the gaseous material stream, to withdraw a low-methane material stream in the liquid state from the $H_2$ separation column and feed it as reflux to the $CO/CH_4$ separation column. Preferably, in this case, cooling the low-methane material stream before it is introduced into the $CO/CH_4$ separation column is dispensed with. This process variant can be employed with particular preference when an $H_2$ separation column is used which is constructed in the lower part thereof as a dividing wall column. It is possible by this means to obtain a low-hydrogen material stream as a considerably lower methane content than a gaseous material stream having the same hydrogen content, and so in the $CO/CH_4$ separation column, a markedly higher purity of the carbon monoxide-rich gas phase can be achieved.

The $CO/CH_4$ separation column is preferably operated at a pressure which permits the carbon monoxide-rich gas phase, after it is warmed against process streams that are to be cooled, to be released to a consumer at a pressure that is equal to or greater than that which is required by the consumer for the carbon monoxide product. Preferably, the $CO/CH_4$ separation column is operated at a pressure between 8 and 10 bar(a).

In a development of the process according to the invention, it is proposed to provide cold, in particular the peak cold required for the process, via a cooling circuit in which nitrogen is used as refrigerant. The nitrogen circuit has no connection to a combustible and/or toxic process gas, and so expediently, for operation thereof, a compressor is used which is neither constructed so as to be explosion-protected, nor operated in a specially safeguarded zone.

The invention further relates to a device for the cryogenic separation of a methane-containing feed gas predominantly consisting of hydrogen and carbon monoxide, having at least one heat exchanger for cooling and partial condensation of the feed gas, a separator in which a first liquid phase can be separated off from the partially condensed feed gas, an $H_2$ separation column that is heatable via a circulation heater and in which a second liquid phase can be generated from the first liquid phase by separating off hydrogen, and also a $CO/CH_4$ separation column, in which a carbon monoxide-rich gas phase can be separated off from the second liquid phase at a purity that permits release thereof as carbon monoxide product.

The object in question is achieved according to the invention in terms of the device in that the $H_2$ separation column is connected to the $CO/CH_4$ separation column in such a manner that a low-methane material stream can be withdrawn from the $H_2$ separation column via a take-off site and can be applied to the $CO/CH_4$ separation column as reflux.

In order to be able to liquefy a material stream that is withdrawn in the gaseous state from the $H_2$ separation column before it is introduced into the $CO/CH_4$ separation column, the invention provides a cooling appliance which is arranged between the two separation columns. Preferably, the cooling appliance is a heat exchanger which is also used for cooling and/or partial condensation of the feed gas. Construction of the cooling appliance as an independent heat exchanger is not to be excluded, however.

The $H_2$ separation column has a plurality of material-transfer appliances arranged vertically one above the other that represent practical separation stages and which preferably are constructed as sieve trays and/or slotted bubble-cap trays and/or structured packings and/or dumped-bed packings. Beneath the practical separation stages, there is situated the sump space of the column, to which heat can be fed via the circulation heater.

If the low-methane material stream is to be withdrawn in the gaseous state from the $H_2$ separation column, the take-off site is preferably located below the sixth practical separation stage of the first separation column. Particularly preferably, it is arranged between the sump space and the third practical separation stage.

In an expedient embodiment of the invention, the $H_2$ separation column, in the lower part thereof, has a vertically upright dividing wall that divides the column cross section into two segments. At the upper end of the dividing wall, there is situated an introduction site, via which part of the first liquid phase can be introduced into one of the segments, and also a cooling appliance for condensing gas that ascends upwardly from the sump space over the other segment. This appliance that is to be termed dividing wall column permits a low-methane liquid phase to be generated, which, on account of the composition thereof can be used as reflux in the $CO/CH_4$ separation column. The dividing wall column for this purpose is constructed having a take-off site preferably arranged immediately below the cooling appliance, via which take-off site a low-methane material stream can be withdrawn in the liquid state and can be fed via a liquid line to the $CO/CH_4$ separation column. The liquid line is in the simplest case constructed as a pipe and, usefully, does not comprise an appliance for cooling the low-methane liquid phase.

A particularly preferred variant of the device according to the invention provides a cooling circuit that is operable with nitrogen as refrigerant running via the heat exchanger or heat exchangers for cooling and partial condensation of the feed gas, via which, in particular, the peak cold required at the separator can be provided for the gas separation. To drive the nitrogen that is circulatable as a refrigerant, the cooling circuit expediently comprises a non-explosion-proof compressor having fewer than three compressor stages. In addition, the cooling circuit can have a feed appliance arranged at the suction side of the compressor for introducing gaseous nitrogen into the circuit, and also a take-off appliance for taking off excess nitrogen from the circuit, which is situated on the pressure side of the compressor. Preferably, the cooling circuit comprises a further heat exchanger for condensation of gaseous nitrogen, into which the circulation heater of the $CO/CH_4$ separation column is integrated.

BRIEF DESCRIPTION OF DRAWINGS

Hereinafter, the invention is to be described in more detail with reference to two exemplary embodiments which are schematically illustrated in FIGS. 1 and 2.

In both figures, the same plant components and process streams are labelled with the same reference signs.

Figure 1:
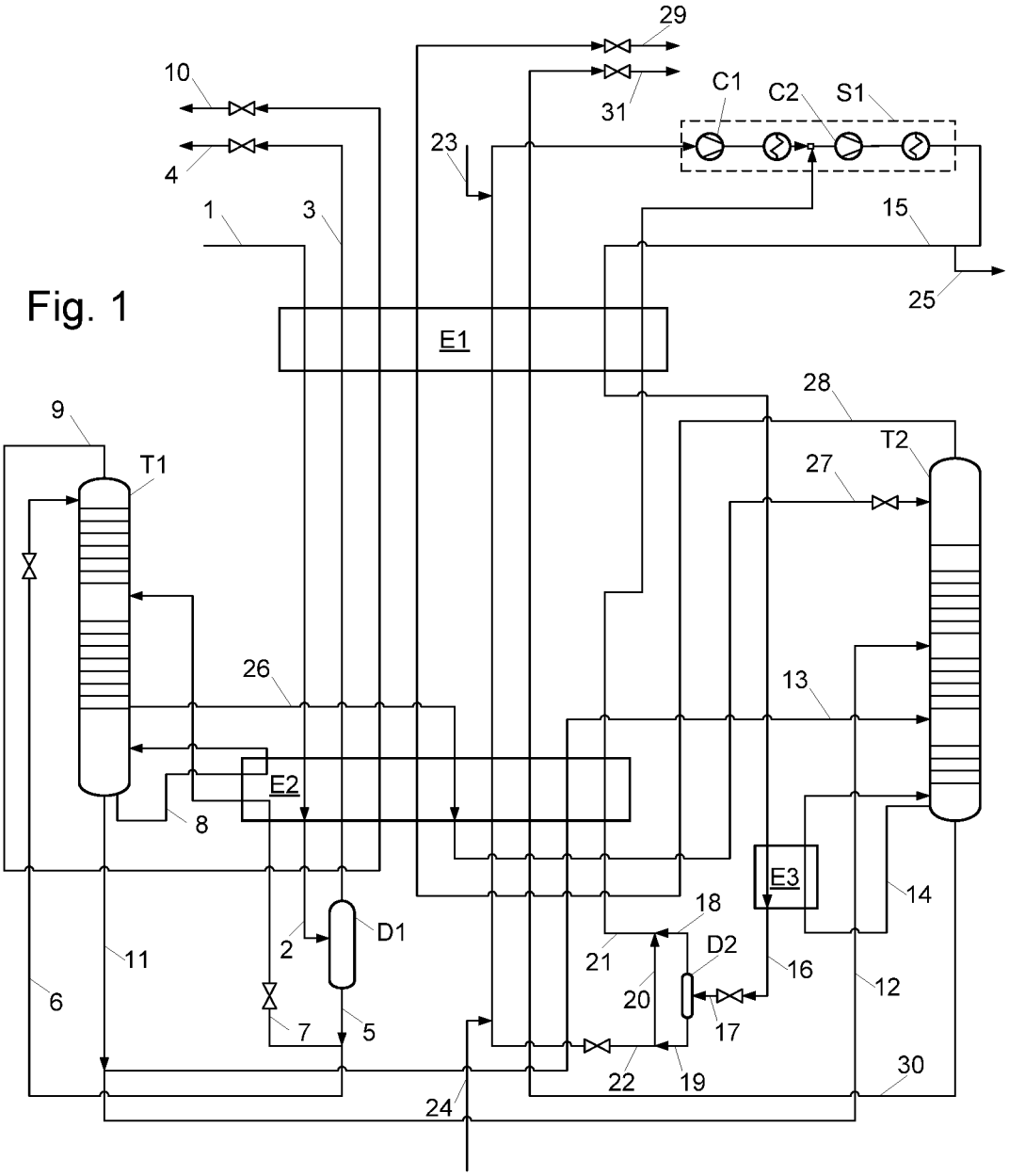
FIG. 1 shows an embodiment of the process according to the invention, in which a material stream provided as reflux for the $CO/CH_4$ separation column is withdrawn from the $H_2$ separation column in the gaseous state.

In FIG. 1, a methane-containing feed gas 1 that is to be separated and predominantly consists of hydrogen and carbon monoxide, that is present at a pressure between 30 and 60 bar(a) is cooled in the first heat exchanger E1 and the second heat exchanger E2 against process streams that are to be warmed, wherein a two-phase mixture of material 2 is formed by the condensation of components, which mixture of material is separated in the separator D1 into a hydrogen-containing liquid phase substantially consisting of carbon monoxide and methane and a hydrogen-rich gas phase. The gas phase is withdrawn via line 3 from the separator D1 and, after warming in the heat exchangers E2 and E1, is released as crude hydrogen 4 at the plant limits. The liquid phase 5, in contrast, is fed to the $H_2$ separation column T1. For this purpose, it is split into two substreams, of which the first 6 is expanded as reflux into the head of the $H_2$ separation column T1, while the second substream 7, after expansion and partial vaporization in the heat exchanger E2, is applied to the central part of the $H_2$ separation column T1 as interstage heating.

The $H_2$ separation column T1 is operated at a pressure that is between one third and one half of the pressure of the feed gas 1, and serves for removing the hydrogen dissolved in the liquid phase 5. It is heated by a circulation heater 8 that is integrated in the heat exchanger E2.

The hydrogen-rich overhead fraction 9 from the $H_2$ separation column T1, after it is warmed in the heat exchangers E2 and E1, is released as flash gas 10 at the plant limits, whereas the substantially hydrogen-free sump fraction 11 consisting of carbon monoxide and methane is expanded into the $CO/CH_4$ separation column T2 that is operated at a pressure between 8.5 and 9 bar(a). For this purpose, the sump fraction 11 is split into two substreams, of which one 12 serves as intermediate reflux, and the second 13, after vaporization in the heat exchanger E2, serves as interstage heating. The $CO/CH_4$ separation column T2 is heated via a circulation heater 14 integrated into the heat exchanger E3.

The peak cold required for the process is obtained via a nitrogen circuit driven by the two-stage circuit compressor V. Nitrogen 15 leaves the second compressor stage C2 at a pressure that is typically between 16 and 21 bar(a), is subsequently cooled in the heat exchanger E1 and condensed in the heat exchanger E3 against sump product 14 of the $CO/CH_4$ separation column T2 that is to be warmed. The condensed nitrogen 16 is expanded to an intermediate pressure between 7 and 9 bar(a), wherein a two-phase mixture of material 17 is formed which is separated in the separator D2 into a gas phase 18 and a liquid phase 19. A material stream 21 formed from the gas phase 18 and a part 20 of the liquid phase 19 is completely vaporized at the intermediate pressure level in the heat exchanger E2 and further warmed in the heat exchanger E1 before it is fed on the suction side to the second compressor stage C2. The remaining liquid phase 22 is further expanded to a low-pressure level between 3 and 5 bar(a), vaporized in the heat exchanger E2 and, after it is warmed in the heat exchanger E1, is recirculated via the suction side of the first compressor stage C1 into the circuit compressor V. The liquid phase 19 is divided into the two substreams 20 and 22 in such a manner that the temperature required at the separator D1 is achieved.

If required, external nitrogen can be fed to the closed nitrogen circuit via the low-pressure passage 22, wherein gaseous nitrogen 23 is introduced on the warm side of the heat exchanger E1 and liquid nitrogen 24 on the cold side of the heat exchanger E2. Surplus nitrogen 25 is removed on the pressure side of the circuit compressor V.

To generate a reflux for the $CO/CH_4$ separation column T2, a low-methane gas phase 26 is withdrawn from the $H_2$ separation column T1 below the sixth practical separation stage, cooled and condensed in the heat exchanger E2 and then conducted via line 27 to the head of the $CO/CH_4$ separation column T2. The overhead product 28 of the $CO/CH_4$ separation column T2 has the purity required for a carbon monoxide product and is available at a pressure that is high enough in order to be able to release it, after it is warmed in the heat exchangers E2 and E1, as carbon monoxide product 29 without further compression. In the sump of the $CO/CH_4$ separation column T2, a methane-rich carbon monoxide-containing liquid phase 30 collects that, after vaporization and warming in the heat exchangers E2 and E1 is released as fuel gas 31.

Figure 2:
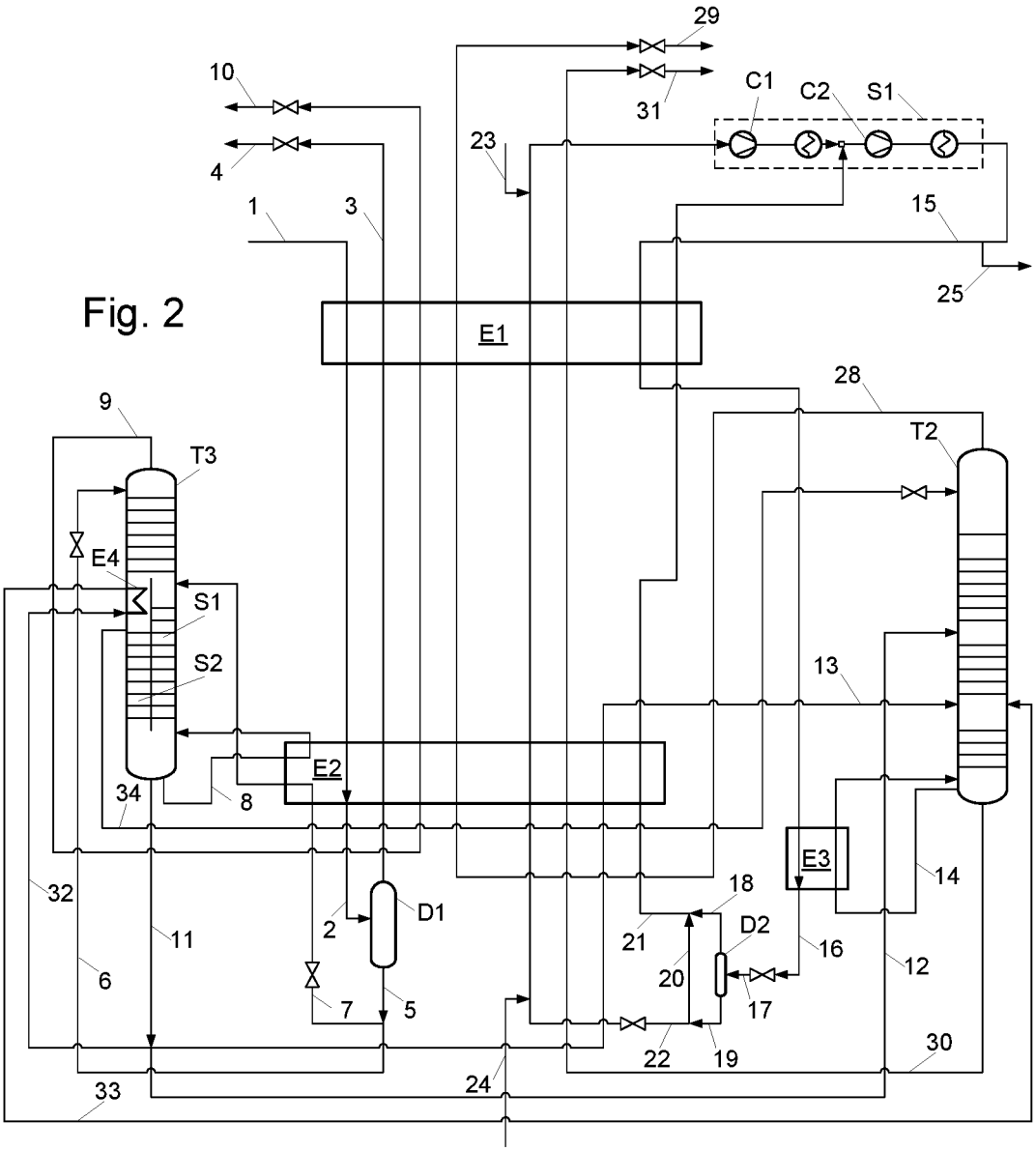
FIG. 2 shows a different embodiment of the process according to the invention, in which a material stream provided as reflux for the second $CO/CH_4$ separation column is withdrawn in the liquid state from the $H_2$ separation column.

The exemplary embodiment shown in FIG. 2 permits the carbon monoxide product 29 to be generated at a higher purity than is possible with the configuration shown in FIG. 1. For this purpose, a column T3 is used for stripping off hydrogen from the liquid phase 5, which column T3, in the lower region thereof, is subdivided by a dividing wall into two segments S1 and S2. At the top end of the segment S1 there is situated the feed site for the substream 7 of the liquid phase 5 that serves as interstage heating, whereas at the top end of the segment S2, a condenser E4 is arranged in which a part 32 of the sump fraction 11 consisting of carbon monoxide and methane is used as refrigerant. The warmed and vaporized refrigerant 33 is then fed together with the substream 13 to the $CO/CH_4$ separation column T2 as interstage heating. In order to avoid methane contaminants of the liquid phase in segment S2, the liquid phase flowing away from the upper region of the column T3 is fed alone to the segment S1. Below the condenser E4, therefore, from the segment S2 a low-methane carbon monoxide fraction 34 can be withdrawn in the liquid state that serves as reflux at the head of the $CO/CH_4$ separation column T2.

The invention claimed is:

1. A process for cryogenic separation of a feed gas containing methane, hydrogen and carbon monoxide, said process comprising:

condensing a portion of said feed gas by cooling to obtain a hydrogen-containing first liquid phase, introducing said first liquid phase into an $H_2$ separation column having a plurality of separation stages wherein said first liquid phase is heated via a circulation heater to generate a second liquid phase containing carbon monoxide and methane by separating off hydrogen from said first liquid phase, introducing said second liquid phase into a $CO/CH_4$ separation column wherein the second liquid phase is separated to obtain a carbon monoxide-containing gas phase, and withdrawing a methane-containing material stream from the $H_2$ separation column and introducing said methane-containing material stream into the $CO/CH_4$ separation column as reflux, wherein the $CO/CH_4$ separation column has an upper region, intermediate region, and a lower region, and wherein the second liquid phase is removed from the $H_2$ separation column and split into a first substream and a second substream, the first substream is introduced as intermediate reflux into the intermediate region of the $CO/CH_4$ separation column, and the second substream, after vaporization in a heat exchanger, is introduced into the $CO/CH_4$ separation column at a point below the introduction of the first substream.

2. The process according to claim 1, wherein said methane-containing material stream is withdrawn in a gaseous state from the $H_2$ separation column and liquefied by cooling before being introduced into said $CO/CH_4$ separation column.

3. The process according to claim 1, wherein said $H_2$ separation column has a column sump and said plurality of separation stages includes more than six separation stages, and said methane-containing material stream is withdrawn from the $H_2$ separation column below the sixth separation stage from the column sump of the $H_2$ separation column.

4. The process according to claim 3, wherein said plurality of separation stages includes a first, a second, and a third separation stage, and said methane-containing material stream is withdrawn from the column sump and/or between the first and third separation stages from the column sump of the $H_2$ separation column.

5. The process according to claim 1, wherein said methane-containing material stream is withdrawn in the liquid state from the $H_2$ separation column.

6. The process according to claim 1, wherein the carbon monoxide-containing gas phase obtained in the $CO/CH_4$ separation column is warmed and discharged from the process, without pressure elevation, as carbon monoxide product.

7. The process according to claim 1, wherein the process is provided via a cooling circuit that uses nitrogen as a refrigerant.

8. A device for cryogenic separation of a feed gas containing methane, hydrogen, and carbon monoxide, said device comprising:

at least one heat exchanger for cooling the feed gas and condensing a portion of the feed gas, a separator in which the condensed portion of the feed gas is separated off as a first liquid phase, an $H_2$ separation column that is heatable via a circulation heater for separating off hydrogen from the first liquid phase to generate a second liquid phase, said $H_2$ separation column having a plurality of separation stages, and a $CO/CH_4$ separation column for separating a carbon monoxide-containing gas phase from the second liquid phase, wherein the $H_2$ separation column is connected to the $CO/CH_4$ separation column in such a manner that a methane-containing material stream can be withdrawn from the $H_2$ separation column from a withdrawal point and introduced into the $CO/CH_4$ separation column as reflux, and wherein the $CO/CH_4$ separation column has an upper region, intermediate region, and a lower region, and wherein the second liquid phase is removed from the $H_2$ separation column and split into a first substream and a second substream, the first substream is introduced as intermediate reflux into the intermediate region of the $CO/CH_4$ separation column, and the second substream, after vaporization in a heat exchanger, is introduced into the $CO/CH_4$ separation column at a point below the introduction of the first substream.

9. The device according to claim 8, further comprising a cooling appliance for liquefying a methane-containing material stream withdrawn from the $H_2$ separation column in the gaseous state, wherein said cooling appliance is arranged between the $H_2$ separation column and the $CO/CH_4$ separation column.

10. The device according to claim 8, wherein the withdrawal point is arranged beneath the sixth separation stage of the $H_2$ separation column.

11. The device according to claim 10, wherein the withdrawal point is arranged between the sump space and the third separation stage of the $H_2$ separation column.

12. The device according to claim 8, wherein the $H_2$ separation column has a lower part which is constructed as a dividing-wall column, from which the methane-containing material stream can be withdrawn in the liquid state.

13. The device according to claim 8, further comprising a cooling circuit using nitrogen as refrigerant.

14. The device according to claim 8, wherein said plurality of separation stages of the $H_2$ separation column are formed from sieve trays and/or slotted bubble-cap trays and/or structured packings and/or dumped-bed packings.

15. The process according to claim 3, wherein said plurality of separation stages includes a first, a second, and a third separation stage, and said methane-containing material stream is withdrawn from between the first and third separation stage from the column sump of the $H_2$ separation column.

16. The process according to claim 1, wherein the $H_2$ separation column has an upper region, central region, and a lower region, and, prior to introducing said first liquid phase into the $H_2$ separation column, said first liquid phase is split into a first substream and a second substream, the first substream is expanded and introduced as reflux into the upper region of the $H_2$ separation column, and the second substream is expanded, a portion of the substream is vaporized by heat exchange, and the second substream is then introduced into the central region of the $H_2$ separation column.

17. The process according to claim 1, wherein the $H_2$ separation column is operated at a pressure that is between one third and one half of the pressure of the feed gas.

18. A process for cryogenic separation of a feed gas containing methane, hydrogen and carbon monoxide, said process comprising:

condensing a portion of said feed gas by cooling to obtain a hydrogen-containing first liquid phase, introducing said first liquid phase into an $H_2$ separation column having a plurality of separation stages wherein said first liquid phase is heated via a circulation heater to generate a second liquid phase containing carbon monoxide and methane by separating off hydrogen from said first liquid phase, introducing said second liquid phase into a $CO/CH_4$ separation column wherein the second liquid phase is separated to obtain a carbon monoxide-containing gas phase, and withdrawing a methane-containing material stream from the $H_2$ separation column and introducing said methane-containing material stream into the $CO/CH_4$ separation column as reflux, wherein the $H_2$ separation column has an upper region and a lower region, the lower region of the $H_2$ separation column being subdivided by a vertical dividing wall into a first segment and a second segment, said first and second segments each having a top end, and, prior to introducing said first liquid phase into the $H_2$ separation column, said first liquid phase is split into a first substream and a second substream, the first substream is expanded and introduced as reflux into the upper region of the $H_2$ separation column, and the second substream is expanded, a portion of the substream is vaporized by heat exchange, and the second substream is then introduced at the top end of the first segment, a condenser is provided at the top end of the second segment, and wherein liquid phase flowing from the upper region of the $H_2$ separation column is fed only to the first segment, and, at a point below the condenser, the methane-containing material stream that is to be introduced into the $CO/CH_4$ separation column as reflux is withdrawn from the second segment.

19. A process for cryogenic separation of a feed gas containing methane, hydrogen and carbon monoxide, said process comprising:

condensing a portion of said feed gas by cooling to obtain a hydrogen-containing first liquid phase and a hydrogen-containing first gas phase, wherein the first gas phase is enriched with hydrogen relative to said feed gas, introducing said first liquid phase into an $H_2$ separation column having a plurality of separation stages wherein said first liquid phase is heated via a circulation heater to generate a second liquid phase containing carbon monoxide and methane and a hydrogen-containing second gas phase by separating off hydrogen from said first liquid phase, wherein the second gas phase is enriched with hydrogen relative to said first liquid phase, introducing said second liquid phase into a $CO/CH_4$ separation column wherein the second liquid phase is separated to obtain a carbon monoxide-containing gas phase, and a methane and carbon monoxide-containing liquid phase, wherein the carbon monoxide-containing gas phase is enriched with carbon monoxide relative to said second liquid phase and the methane and carbon monoxide-containing liquid phase is enriched with methane relative to said second liquid phase, and withdrawing a methane-containing material stream from the $H_2$ separation column and introducing said methane-containing material stream the $CO/CH_4$ separation column as reflux, wherein the $CO/CH_4$ separation column has an upper region, intermediate region, and a lower region, and wherein the second liquid phase is removed from the $H_2$ separation column and split into a first substream and a second substream, the first substream is introduced as intermediate reflux into the intermediate region of the $CO/CH_4$ separation column, and the second substream, after vaporization in a heat exchanger, is introduced into the $CO/CH_4$ separation column at a point below the introduction of the first substream.

* * * * *